US005263752A

United States Patent [19]

Phail-Fausey et al.

[11] Patent Number: 5,263,752

[45] Date of Patent: Nov. 23, 1993

[54] ONE-PIECE STRIKER FOR VEHICLE DOOR LATCH

[75] Inventors: Bryan D. M. Phail-Fausey, Pontiac; Jeffrey L. Konchan, Clarkston, both of Mich.; John F. Reelhorn, Pickerington, Ohio

[73] Assignee: General Motors Corporation, Detroit, Mich.

[21] Appl. No.: 971,159

[22] Filed: Nov. 5, 1992

[51] Int. Cl.[5] ..... E05C 3/26

[52] U.S. Cl. ..... 292/340; 292/216

[58] Field of Search ..... 292/340, 216, 145, 147, 292/281, 283, DIG. 53, 137, 145

[56] References Cited

U.S. PATENT DOCUMENTS

| | | | |
|---|---|---|---|
| 1,472,512 | 10/1923 | Carlson | 292/340 X |
| 1,690,408 | 11/1928 | Hasenflue | 292/340 X |
| 2,723,151 | 12/1952 | Seyforth | 292/340 |
| 2,789,023 | 4/1957 | Johnson | 292/216 X |
| 2,859,430 | 11/1958 | O'Callaghan | 292/340 X |
| 3,431,000 | 3/1969 | Choiniere | 292/95 |
| 3,599,743 | 8/1971 | Hull | 292/216 X |
| 3,785,186 | 1/1974 | James et al. | 292/216 X |
| 3,985,381 | 10/1976 | Kobayashi | 292/216 |
| 4,331,356 | 5/1982 | Noel | 292/281 |
| 4,650,231 | 3/1987 | Shimura et al. | 292/340 |
| 4,703,960 | 11/1987 | Lense | 292/216 X |
| 4,941,696 | 7/1990 | Yamada et al. | 292/340 |
| 4,981,313 | 1/1991 | Makamura | 292/340 |
| 4,998,759 | 3/1991 | Peterson et al. | 292/340 |
| 5,050,917 | 9/1991 | Hamada et al. | 292/340 |
| 5,125,698 | 6/1992 | Thau | 292/340 X |
| 5,163,723 | 11/1992 | Rückert | 292/216 |

*Primary Examiner*—Richard E. Moore

*Attorney, Agent, or Firm*—Charles E. Leahy

[57] ABSTRACT

A one-piece striker for a door latch comprises a base having an integrally attached U-shaped loop of rectangular cross section that is bent upright from the base. The base has a triangular end with one mounting hole at its apex and a peninsula end that has another mounting hole at its free end. The striker is used with a door latch that has a slot for guiding one leg of the loop into an interior mechanism that includes a rotatable fork bolt lever that engages an inside surface of the leg in the latched position.

4 Claims, 2 Drawing Sheets

ONE-PIECE STRIKER FOR VEHICLE DOOR LATCH

BACKGROUND OF THE INVENTION

This invention relates to vehicle door latches and more particularly to a vehicle door latch striker and its method of manufacture.

Automobiles are typically equipped with a latch in the end of each the door that engages a striker that is secured to the confronting face of a vehicle body pillar at the edge of the door opening. The latch, particularly one for a swinging door, has a fishmouth slot that opens toward the vehicle interior and extends through a cutout in the face plate of the latch. This fishmouth slot guides a striker bolt or projection into the interior of the latch as the vehicle door is closed. As the striker projection travels into the fishmouth slot, it "strikes" or engages an internal, pivotally mounted fork bolt lever that is part of the latching mechanism that is inside the latch housing. The striker projection then rotates the fork bolt lever to a latched position where a portion of the fork bolt lever is behind the striker projection and closes off the fishmouth slot. The fork bolt lever is typically held in the latched position by a detent lever or pawl that is released by a door handle when the door is opened.

Modern door latch strikers now generally have a bolt or projection that is part of a bent rod that is attached to a base or bracket that secures the striker to the door pillar. See for instance U.S. Pat. Nos. 4,941,696 Yamada et al; 4,981,313 Makamura; 4,998,759 Peterson et al and 5,050,917 Hamada et al.

SUMMARY OF THE INVENTION

The object of this invention is to provide an improved door latch striker.

One feature of the invention is that the door latch striker has a loop of rectangular cross section for engaging and operating the fork bolt lever of the latching mechanism that provides several advantages.

One advantage is that the rectangularly cross sectioned loop is thinner than the round cross sectioned loop of the prior art door latch strikers while having the same shear strength.

Another advantage is that the thinner loop of rectangular cross section reduces the height of the fishmouth slot and cutout which increases the strength of the door latch and improves the appearance of the door.

Yet another advantage is that the thinner loop of rectangular cross section reduces the distance between the loop and the fork bolt pivot thereby increasing pull out force required at the loop while reducing unlatching effort required at the door handles.

Still yet another advantage is that the fishmouth slot and cutout of reduced height increases the overlap and consequently the retention of the fork bolt in the latched position.

Another feature of the invention is that the striker is of one piece construction for economy of manufacture.

Yet another feature of the invention is that the one-piece striker is configured for excellent material utilization in the manufacturing process.

Still yet another feature of the invention is that the one-piece striker is configured for efficient installation and improved appearance when installed.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
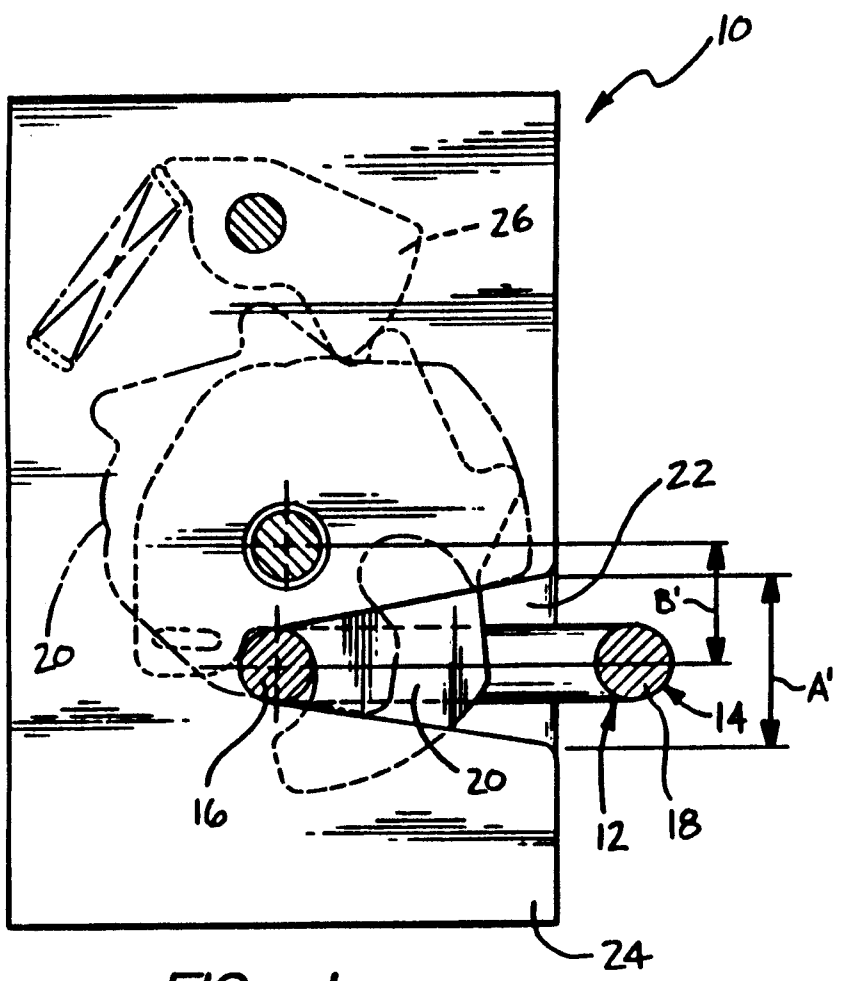
FIG-1 PRIOR ART
FIG. 1 is a front view of a schematically illustrated vehicle door latch engaging a prior art striker.

Referring now to the drawing, FIG. 1 schematically illustrates a vehicle door latch 10 that is mounted on the free end of a swinging vehicle door (not shown) and engages a prior art striker 12 that is attached to the confronting face of the door pillar (not shown) when the door is closed.

The prior art striker 12 comprises a projection that is in the form of a round wire or rod that is bent into U-shaped loop 14 having two parallel legs 16 and 18 that are joined at one end by a generally linear cross piece 20. The opposite ends of the round wire legs 16 and 18 are secured to a base plate (not shown) which in turn is secured to the door pillar.

The door latch 10 has a fishmouth slot 22 that opens toward the vehicle interior and extends through a corresponding cutout in a face plate 24 of the door latch 10. This fishmouth slot 22 guides leg 16 of the prior art striker 12 into the interior of the door latch 10 as the vehicle door is closed. The striker leg 16 "strikes" or engages an internal, pivotally mounted fork bolt lever 24 as it is guided into the fishmouth slot 22 and rotates the fork bolt lever 24 to a latched position where a portion of the fork bolt lever 24 engages an inside surface of striker leg 16 and closes off the fishmouth slot 22 behind the striker leg 16. The fork bolt lever 24 is held in the latched position by a detent lever or pawl 26 that is released by a door handle when the door is opened.

Figure 2:
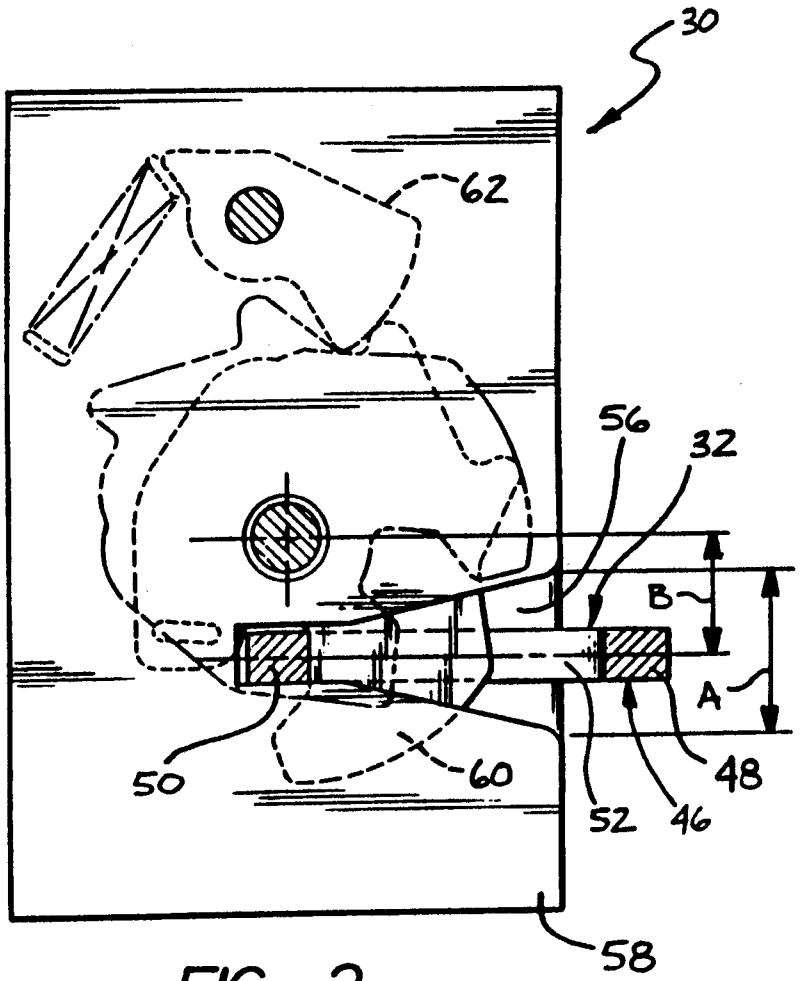
FIG. 2 is a front view of a schematically illustrated vehicle door latch engaging a one-piece striker in accordance with this invention.

Referring now to FIG. 2, it schematically illustrates a vehicle door latch 30 engaging a one-piece striker 32 in accordance with this invention. The vehicle door latch 30 is also mounted on the free end of a swinging vehicle door (not shown) so as to engage the striker 32 when it is attached to the confronting face of the door pillar (not shown) when the door is closed.

Figure 3:
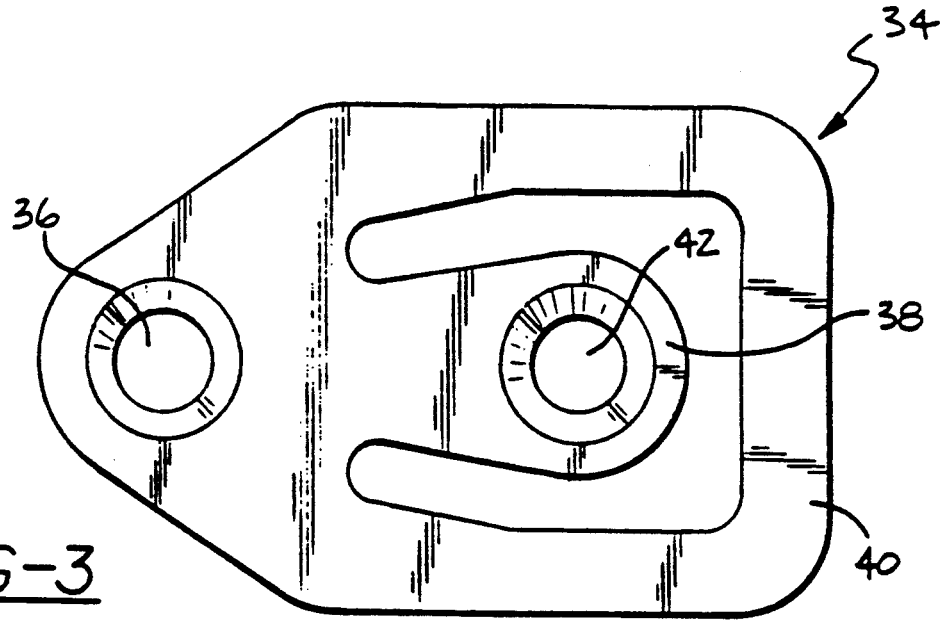
FIG. 3 is a plan view of a stamped metal blank for making the one-piece striker of this invention that is shown in FIG. 2.
Figure 4:
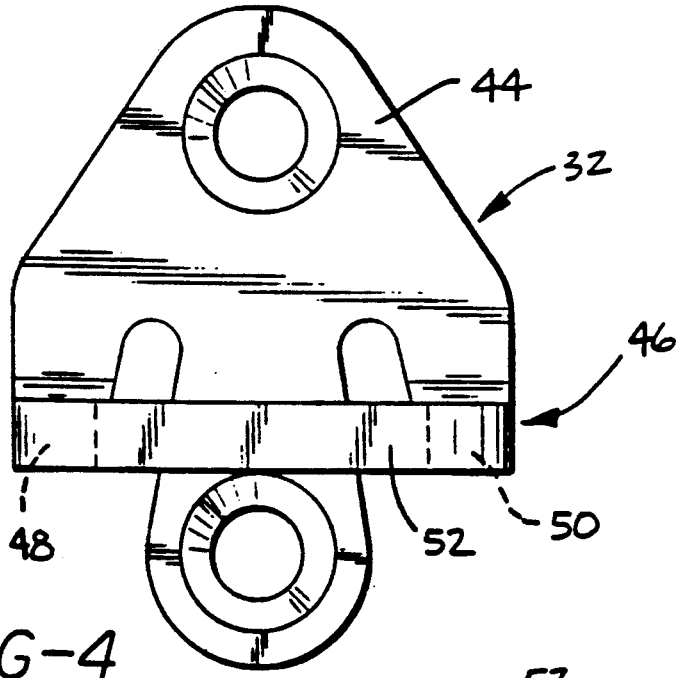
FIG. 4 is a front view of the one-piece striker of this invention that is made from the blank that is shown in FIG. 3.
Figure 5:
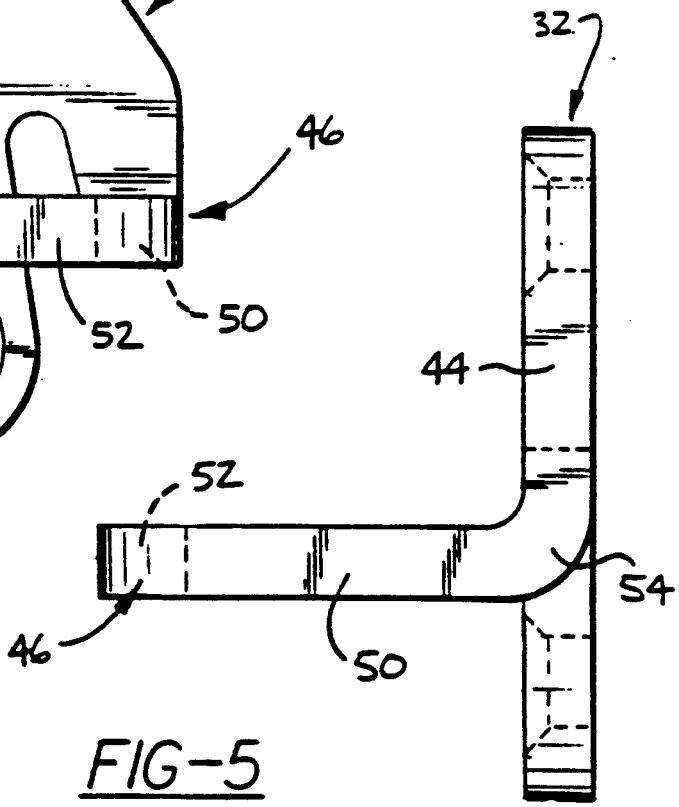
FIG. 5 is a side view of the one-piece striker that is shown in FIG. 4.

Referring now to FIGS. 3, 4 and 5, the striker 32 is of one-piece construction. It is made by stamping flat bar stock to form the flat stamped blank 34 that is shown in FIG. 3. One end of the stamped blank 34 is triangular and it has a single mounting hole 36 at the apex of the triangular end. The other end of the stamped blank 34 has a U-shaped slot that divides the other end into an inner peninsula 38 that is inside an outer loop 40 of rectangular cross section that is as wide as the stamped blank 34 and the flat bar stock that is made from. The peninsula 38 has a single mounting hole 42 at its free end that is aligned with the mounting hole 36 in the triangular end.

The end portion of the loop 40 is bent upright to provide the one-piece striker 32 as shown in FIGS. 4 and 5. The one-piece striker 32 now has a base 44 and an integrally attached loop 46 of rectangular cross section; the base comprising the triangular end and peninsula of the blank with the two mounting holes 36 and 42 respectively; and the loop comprising the end portion of the loop 40. Thus the base 44 of the one piece striker 32 is equipped with just two aligned mounting holes 36 and 42 so that the one-piece striker 32 can be installed on the door pillar efficiently and effectively by using just two fasteners that provide adequate securement. Moreover the installed one-piece striker 32 has an improved appearance due to the absence of redundant and unnecessary fasteners.

It should also be noted that the peninsula end of the base 44 is cut out from the interior of the blank loop 40 and that the triangular end of the base 44 is within the width of the blank loop 40. Thus very little offal is produced when the blank 34 is formed and consequently there is excellent material utilization when the one-piece striker 32 is manufactured in the above manner.

As indicated above the one-piece striker 32 has a loop 46 of rectangular cross section. This loop 46 comprises legs 48 and 50 of substantially uniform width and thickness that are joined by the cross bar 52 of substantially uniform width and thickness, that is preferably the same as that of the legs. This shape maximizes the inside latching surfaces of the striker legs 48 and 50. The other end of the legs 48 and 50 are integrally connected to the base 44 by bights 54 that result from the blank loop 40 being bent upright from the plane of the blank 34 that is shown in FIG. 3.

Returning now to FIG. 2, the door latch 10 has a fishmouth slot 56 that opens toward the vehicle interior and extends through a corresponding cutout in a face plate 58 of the door latch 30. This fishmouth slot 22 guides rectangularly cross sectioned leg 50 of the one-piece striker 32 into the interior of the door latch 30 as the vehicle door is closed. The striker leg 50 "strikes" or engages an internal, pivotally mounted fork bolt lever 60 as it is guided into the fishmouth slot 56 and rotates the fork bolt lever 60 to a latched position where a flat edge portion of the fork bolt lever 60 engages the flat inside surface of the striker leg 50 and closes off the fishmouth slot 56 behind the striker leg 50. The fork bolt lever 60 is held in the latched position by a detent lever or pawl 62 that is released by a door handle when the door is opened.

The fact that the one-piece striker 32 has a loop 46 of rectangular cross section for engaging and operating the fork bolt lever 60 of the door latch 30 provides several advantages.

One advantage is that the rectangularly cross sectioned loop 46 is thinner than a prior art round wire loop 14 while having the same sheer strength. Consequently the height A of the fishmouth slot and cutout 56 of door latch 30 is reduced in comparison to the height A' of the fishmouth slot and cutout 22 of door latch 10 as shown in FIGS. 1 and 2. This increases the strength of the door latch 30 that is used in conjunction with the improved one-piece striker 32 and improves the appearance of the door.

Moreover, the thinner rectangularly sectioned loop 46 of the improved one-piece striker 32 also reduces the distance B between the loop 46 and the fork bolt pivot in the door latch 30 in comparison to the distance B' between the round wire loop 14 of the prior art and the fork bolt pivot in the door latch 10. This increases the pull out force required at the loop while reducing the unlatching effort that is required at the door handles when a door latch is used in conjunction with the improved striker of the invention.

Furthermore the fishmouth slot and cutout 56 of reduced height increases the overlap and consequently the retention of the fork bolt lever 60 in the latched position in comparison to the fork bolt lever 20 that is used in conjunction with the prior art striker.

While the invention has been described in connection with the striker leg 50 engaging in the door latch 30, the striker 32 can be mounted upside down, in which case striker leg 48 would be engaged in the door latch 30.

In other words, the invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A striker for use with a vehicle door latch that has a slot for guiding a projection of the striker into an inner latching mechanism of the door latch that has a rotatable fork bolt for engaging an inside surface of the projection of the striker in a latched position inside the door latch comprising:

a one piece construction including a base for attaching the striker to a vehicle pillar that confronts the vehicle door latch when the vehicle door is closed, and an upright loop of rectangular cross section that is integrally attached to the base for latchably engaging the rotatable fork bolt in the vehicle door latch, the loop having legs of substantially uniform width and thickness that are joined at one end by a cross bar of substantially uniform width and thickness and the base having a width that does not exceed the width of the loop, said base having a first mounting end that is triangular and has a single mounting hole that is at the apex of the mounting end and a second mounting end that is a peninsula that is smaller that the loop and that has a single mounting hole at the free end of the second mounting end that is aligned with the mounting hole in the triangular end.

2. A one-piece striker for use with a vehicle door latch that has a slot for guiding a projection of the striker into an inner latching mechanism of the door latch that has a moveable inner member for engaging an inside surface of the projection of the striker in a latched position inside the door latch comprising:

a base for attaching the striker to a vehicle pillar that confronts the vehicle door latch when the vehicle door is closed, the base having a first triangular end with a single mounting hold at the apex of the first end and a second peninsula end with a single mounting hole at the first end of the peninsula that is aligned with the mounting hole in the triangular end, an upright loop of rectangular cross section that is integrally attached to the base between the first and second ends and that has a leg of substantially uniform width and thickness for latchably engaging the inner moveable member of the vehicle door latch.

the peninsula end being smaller than the loop cut out from the blank material left from forming the loop and the base having a width that does not exceed the width of the loop.

3. The striker as defined in claim 1 wherein the width of the loop is the same as the width of flat bar stock for making the one-piece striker and the first mounting end does not exceed the width of the loop whereby the one-piece striker is made with excellent material utilization.

4. The striker as defined in claim 2 wherein the width of the loop is the same as the width of flat bar stock for making the one-piece striker and the triangular end does not exceed the width of the loop whereby the one-piece striker is made with excellent material utilization.

* * * * *